US009343026B2

(12) United States Patent
Tai et al.

(10) Patent No.: US 9,343,026 B2
(45) Date of Patent: May 17, 2016

(54) PIXEL CIRCUIT FOR ACTIVE MATRIX DISPLAY APPARATUS AND THE DRIVING METHOD THEREOF

(71) Applicant: National Chiao Tung University, Hsinchu (TW)

(72) Inventors: Ya-Hsiang Tai, Miaoli County (TW); Lu-Sheng Chou, Kaohsiung (TW); Chun-Yu Lin, Taichung (TW); Chia-Hung Chang, Taichung (TW)

(73) Assignee: NATIONAL CHIAO TUNG UNIVERSITY, Hsinchu (TW)

( * ) Notice: Subject to any disclaimer, the term of this patent is extended or adjusted under 35 U.S.C. 154(b) by 136 days.

(21) Appl. No.: 14/265,500

(22) Filed: Apr. 30, 2014

(65) Prior Publication Data

US 2015/0077010 A1 Mar. 19, 2015

(30) Foreign Application Priority Data

Sep. 13, 2013 (TW) ..... 102133274 A
Jan. 27, 2014 (TW) ..... 103102871 A

(51) Int. Cl.
*G09G 3/36* (2006.01)

(52) U.S. Cl.
CPC ..... *G09G 3/3648* (2013.01); *G09G 2310/0251* (2013.01)

(58) Field of Classification Search
CPC ..... G09G 3/3648; G09G 2310/0251; G09G 3/3225; G09G 3/3655; G09G 2300/0809; G09G 2310/0248; G09G 2320/0223; G09G 2320/0252
See application file for complete search history.

(56) References Cited

U.S. PATENT DOCUMENTS

2005/0104820 A1* 5/2005 Komiya ..... G09G 3/325 345/76
2006/0232505 A1* 10/2006 Asada ..... G09G 3/3648 345/55
2007/0210994 A1* 9/2007 Chen ..... G09G 3/3233 345/76
2008/0048947 A1* 2/2008 Liu ..... G09G 3/3233 345/77
2010/0259531 A1* 10/2010 Ono ..... G09G 3/3233 345/212
2012/0306843 A1* 12/2012 Wang ..... G09G 3/3258 345/212
2013/0069966 A1* 3/2013 Zhao ..... G09G 3/3648 345/545

* cited by examiner

*Primary Examiner* — Premal Patel
(74) *Attorney, Agent, or Firm* — Bacon & Thomas, PLLC

(57) ABSTRACT

Provided is the pixel circuit for active matrix display apparatus and the driving method thereof, which is controlled by digital signal. The pre-charge pixel voltage is controlled and discharged by controlling the resistor and transistors, so that the desired grey scale is generated. The pixel circuit includes: a first switch, a second switch, a third switch, an energy storage device and resistor. By controlling the third switch, the first end of the energy storage device is charged to the voltage of the second source. The first switch and the second switch are controlled to switch on, so that the first end of the energy storage device discharging to the first source. The second switch switches off when the first end of the energy storage device reaches the desired pixel voltage.

4 Claims, 3 Drawing Sheets

PIXEL CIRCUIT FOR ACTIVE MATRIX DISPLAY APPARATUS AND THE DRIVING METHOD THEREOF

BACKGROUND OF THE INVENTION

1. Field of the Invention

The present invention relates to a pixel circuit for active matrix display apparatus, particularly to a flat active matrix display controlled by full digital signal to reach the pixel circuit with the desired grey scale.

2. Description of the Prior Art

The flat display device has the advantages of light weight, low power consumption and low radiation etc. At present, the commercial flat display devices include the liquid crystal display and the organic light emitting diode display device, which have been widely used in the portable products, such as the notebook, digital camera, global positioning system and intellectual mobile phone, even the driving recorder etc.

The liquid crystal display is widely used particularly in the flat display device. Recently, the liquid crystal screen and the liquid crystal television are very popular, which are used to substitute the traditional bulky cathode ray tube (CRT) display and television. However, there are a lot of shortcomings for the liquid crystal display, for example: due to the limit for the characteristics of liquid crystal molecule, during the switching of image data, the liquid crystal molecules should be controlled and twisted to change the direction of their arrangement, the picture will be delayed, this delay will cause the residual image on the display. Thus, in order to respond the quick switch of multi-media image, the response speed of liquid crystal molecules should be improved.

When large-size flat display device is designed, in order to reach high resolution, shorter charging time is required. Due to the signal line will be lengthened with respect to larger size of flat display device, the inner resistance effect of signal line will be significant, which is called the RC-delay. The RC-delay will severely influence the uniformity for the luminance of flat display device, this is a main issue which should be resolved for large-size flat display device.

In order to solve the abovementioned issue of RC-delay, the conventional technique is to add a digital/analog signal switcher except the pixel circuit to control the charging time of capacitor. The common digital/analog signal switcher includes many driving circuits, which has to switch the digital signal into the analog signal, then inputs it into the pixel circuit for driving. The extra power will be increased in the process. Meantime, the driving force will be insufficient for large-size on high-resolution flat display device. Furthermore, the design and disposition of pixel will become much complicated. The complicate circuit will reduce the opening rate greatly, even more transistors and memories are required at the input end, which will increase the process difficulty and manufacturing cost greatly.

Therefore, in order to generate more efficient circuit device, it is necessary to research and develop the innovative pixel circuit technique, to improve the use efficiency, and reduce the manufacturing time and manufacturing cost.

SUMMARY OF THE INVENTION

The purpose of present invention is to provide the pixel circuit for active matrix display apparatus, which is to provide the data line voltage, scan line voltage and digital control, in order to control the pixel circuit of active matrix display apparatus of grey scale.

The present invention provides the pixel circuit for active matrix display apparatus, the pixel circuit includes: a first switch, a second switch, a third switch, and an energy storage device and resistor. The control end of first switch is coupled to scan line. The second end of the second switch is coupled to the first end of the first switch. The first end of the second switch is coupled to the first source. The control end of the second switch is coupled to the data line. The second end of the third switch is coupled to the second source. The first end of the energy storage device is coupled to the first end of the third switch. The resistor is coupled to the second end of the first switch and the first end of the third switch.

Regarding the pixel circuit for active matrix display apparatus provided by the present invention, the first switch, the second switch and the third switch are transistors and the energy storage device is capacitor.

Another purpose of the present invention is to provide the pixel circuit for active matrix display apparatus and the driving method thereof, the pixel circuit includes: a first switch, a second switch, a third switch, and an energy storage device and resistor. The control end of first switch is coupled to scan line. The second end of the second switch is coupled to the first end of the first switch. The first end of the second switch is coupled to the first source. The control end of the second switch is coupled to the data line. The second end of the third switch is coupled to the second source. The first end of the energy storage device is coupled to the first end of the third switch. The resistor is coupled to the second end of the first switch and the first end of the third switch. By controlling the third switch, the first end of the energy storage device is charged to the voltage of the second source. The first switch and the second switch are controlled to switch on, so that the first end of the energy storage device discharging to the first source. The second switch switches off when the first end of the energy storage device reaches the desired pixel voltage. Or, by controlling the first switch, the first end of the energy storage device is charged to the voltage of the second source. The third switch and the second switch are controlled to switch on, so that the first end of the energy storage device discharging to the first source. The second switch switches off when the first end of the energy storage device reaches the desired pixel voltage.

Regarding the pixel circuit for active matrix display apparatus provided by the present invention, the first switch, the second switch and the third switch are transistors and the energy storage device is capacitor.

Regarding the pixel circuit for active matrix display apparatus provided by the present invention, the first source is a common voltage.

Regarding the pixel circuit for active matrix display apparatus provided by the present invention, the first switch, the full digital signal is used to control the discharging the reach the pixel circuit with desired grey scale, and extra digital/analog signal switcher is not required to be added for the pixel circuit.

Regarding the pixel circuit for active matrix display apparatus provided by the present invention, the data line voltage and the scan line voltage are controlled by digital signal, and the thin film transistor is used as the switch to set the pulse time of digital signal directly to charge the capacitor. During the charging process of capacitor, the pulse switches off when the capacitor reaches the desired voltage. At this time, the capacitor will keep that voltage to control the lighting device.

Therefore, the advantage and spirit of the present invention can be understood further by the following detail description of invention and attached Figures.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DESCRIPTION OF THE PREFERRED EMBODIMENT

Regarding the pixel circuit for active matrix display apparatus provided by the present invention, the technical content, characteristics and performance will be revealed clearly in the following preferred embodiment and Figure.

Figure 1:
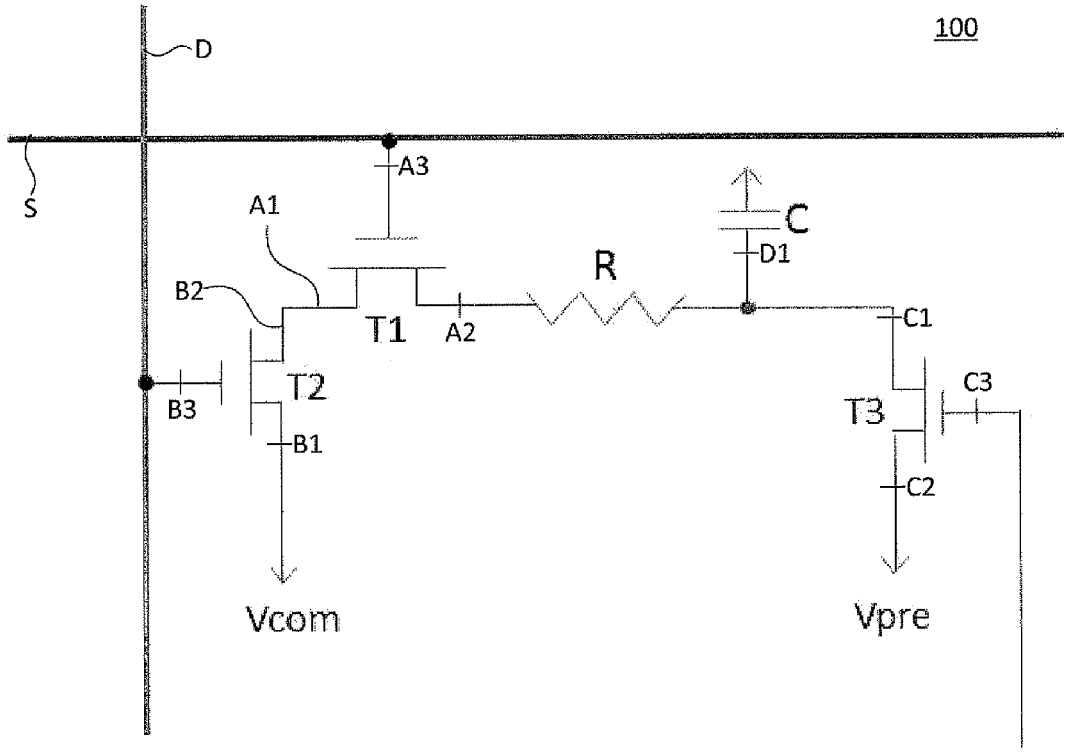
FIG. 1 illustrates an embodiment of the pixel circuit for active matrix display apparatus provided by the present invention.

Please refer to FIG. 1, which illustrates the pixel circuit 100 for active matrix display apparatus, the pixel circuit 100 comprises: a first switch T1, a second switch T2, a third switch T3, and an energy storage device C and resistor R. The control end A3 of first switch T1 is coupled to scan line S. The second end B2 of the second switch T2 is coupled to the first end A1 of the first switch T1. The first end B1 of the second switch T2 is coupled to the first source Vcom. The control end B3 of the second switch T2 is coupled to the data line D. The second end C2 of the third switch T3 is coupled to the second source Vpre. The third switch T3 has a control end C3. It is noted that the first switch T1, the second switch T2 and the third switch T3 are transistors.

As shown in FIG. 1, the first end D1 of the energy storage device C is coupled to the first end C1 of the third switch T3. The resistor R is coupled to the second end A2 of the first switch T1 and the first end C1 of the third switch T3. It is noted that the energy storage device C is a capacitor. In an embodiment of the present invention, the first source Vcomm is a common voltage.

As shown in FIG. 1, the following driving method is used to set the pixel voltage of the pixel circuit 100 for active matrix display apparatus of the present invention. It comprises: controlling the third switch T3 to pre-charge the first end D1 of the energy storage device C to the voltage of the second source Vpre. Then, the first switch T1 and the second switch T2 are controlled to switch on, so that the first end D1 of the energy storage device C is discharging to the first source Vcom. Finally, the second switch T2 switches off when the first end D1 of the energy storage device C reaches the desired pixel voltage.

As shown in FIG. 1, the operation steps of the present invention comprises: controlling the first switch T1 to pre-charge the first end D1 of the energy storage device C to the voltage of the second source Vpre. Then, the third switch T3 and the second switch T2 are controlled to switch on, so that the first end D1 of the energy storage device C is discharging to the first source Vcom. Finally, the second switch T2 switches off when the first end D1 of the energy storage device C reaches the desired pixel voltage.

As shown in FIG. 1, the pixel circuit of the present invention can be controlled by full digital signal through setting the abovementioned pixel voltage. The pre-charge pixel voltage (i.e., the voltage of the first end D1 of the energy storage device C) of pixel circuit 100 can be controlled and discharged by controlling the resistor and transistors, so that the desired grey scale is generated.

Figure 2:
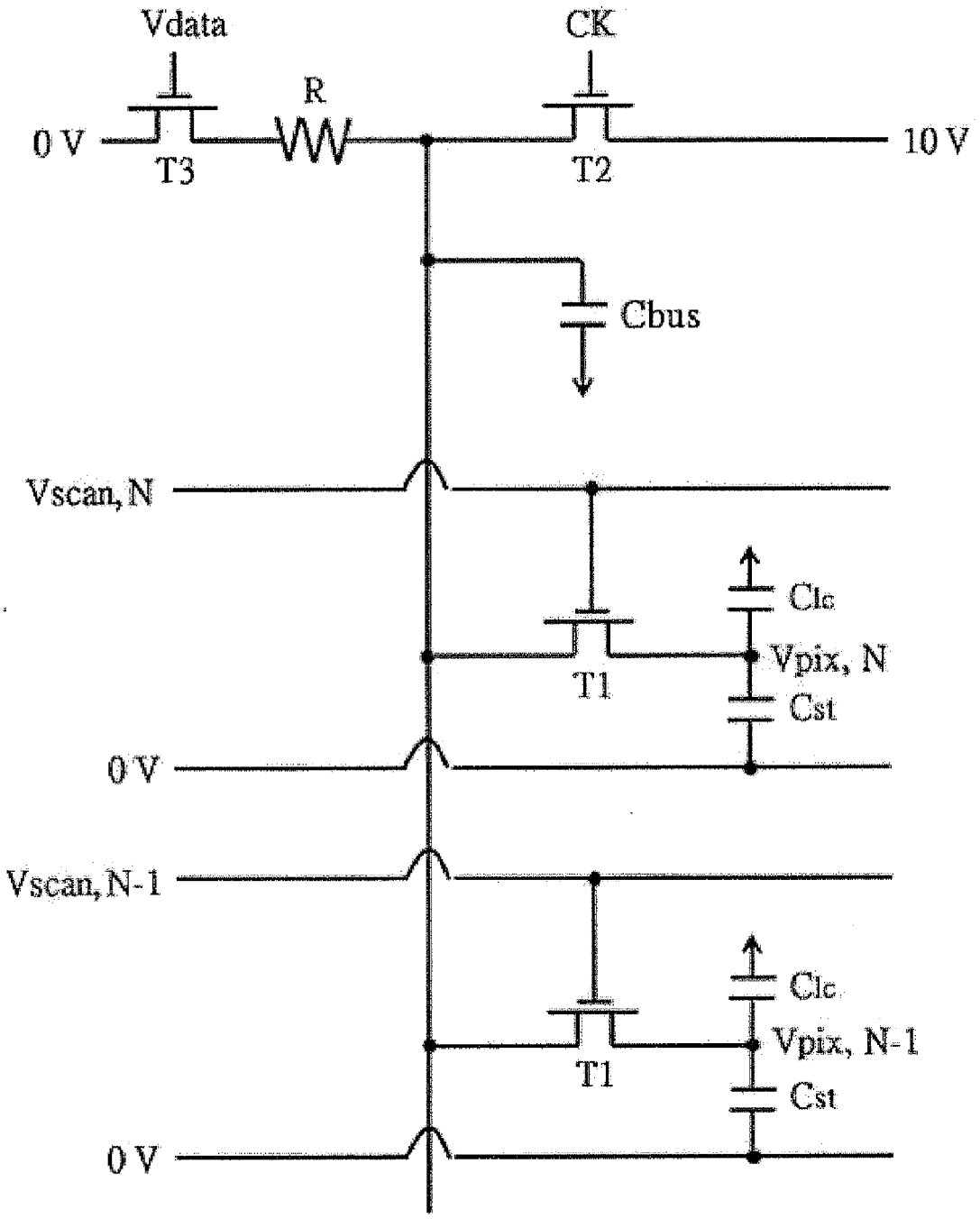
FIG. 2 illustrates the data line circuit for the liquid crystal display apparatus provided by the present invention.
Figure 3:
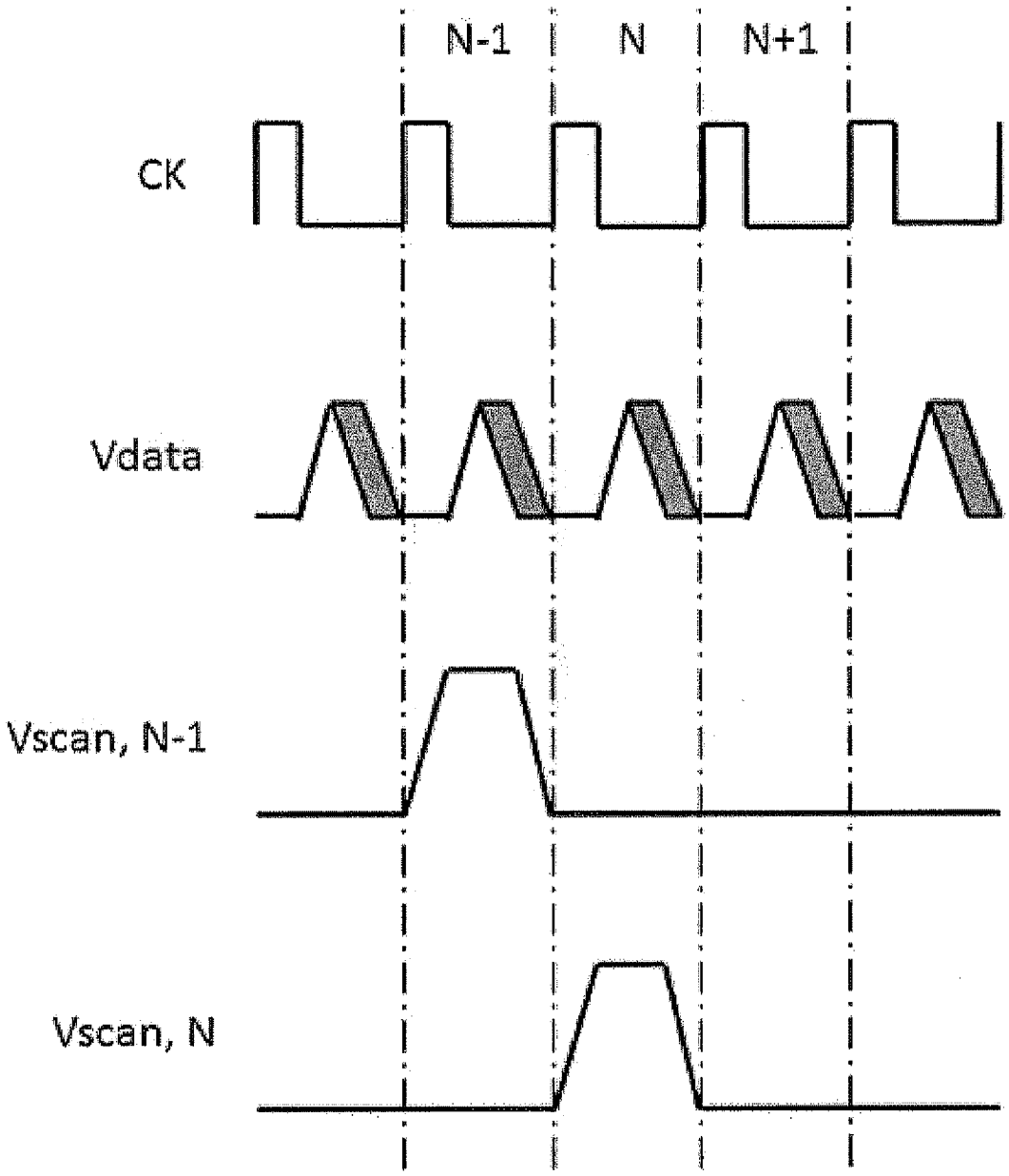
FIG. 3 illustrates the time sequence for the data line circuit of liquid crystal display apparatus provided by the present invention.

Please refer to FIG. 2, FIG. 3. FIG. 2 illustrates the data line circuit for the liquid crystal display apparatus provided by the present invention. FIG. 3 illustrates the time sequence for the data line circuit of liquid crystal display apparatus provided by the present invention. From FIG. 2, it is known that the pixel N−1, N is used as the example to describe this embodiment. As for the example of the Nth time sequence: In the Nth time sequence, the scan line Vscan,N opens the fourth switch T, and copes with signal CK high potential to opens the first switch T1, in order to charge the node Vpix,N to a constant value of 10V, and the second switch T2 is not opened at this time. Then, after the signal CK closes the first switch T1, the signal Vdata will open the second switch T2. At this time, the node Vpix,N will be discharged to 0V through the fourth switch T, the resistance R, and the second switch T2. Finally, under the discharging process, the pulse width of signal Vdata (grey part) is changed to control the close time of the second switch T2, in order to obtain different voltage (i. e. grey scale) by this node Vpix,N.

The present invention integrates the digital/analog signal switcher into every pixel through RC charging-discharging. The external digital signal can be inputted to control the grey scale of every pixel, in order to reduce the complexity for the external circuit of pixel effectively.

The present invention uses the RC charging-discharging apparatus to reduce the loss of opening rate of pixel circuit by simple way. Thus, the pixel circuit provided by the present invention has the following characteristics:

1. The digital/analog signal switcher can be integrated into every pixel through RC charging-discharging way.
2. The RC charging-discharging time and the desired voltage and grey scale of pixel can be adjusted by controlling the external digital signal.
3. The external pixel circuit of the present invention is very simple, which can reduce the manufacturing cost.
4. Comparing the present invention and common pixel circuit, the power consumption can be reduced and can be applied in large-size or high-resolution flat display device.
5. Comparing the present invention and DAC integrated pixel method provided by other technique, it has simpler circuit and higher opening rate.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertain.

What is claimed is:

1. A pixel circuit, comprising:

a first switch, a control end of said first switch is coupled to a scan line;

a second switch, a second end of said second switch is coupled to a first end of said first switch, a first end of said second switch is coupled to a first source, a control end of said second switch is coupled to a data line;

a third switch, a second end of said third switch is coupled to a second source;

an energy storage device, a first end of the energy storage device is coupled to a first end of said third switch; and a resistor, said resistor is coupled to a second end of said first switch and said first end of said third switch;

wherein, controlling said third switch, said first end of said energy storage device is charged to a voltage of said second source, said first switch and said second switch are controlled to switch on, so that said first end of said energy storage device discharging to said first source, said second switch switches off when said first end of said energy storage device reaches a desired pixel voltage.

2. The pixel circuit according to claim 1, wherein said first switch, said second switch and said third switch comprise transistor.

3. The pixel circuit according to claim 1, wherein said energy storage device comprises capacitor.

4. The pixel circuit according to claim 1, wherein said first source comprises common voltage.

* * * * *